US006570496B2

(12) United States Patent
Britton

(10) Patent No.: US 6,570,496 B2
(45) Date of Patent: May 27, 2003

(54) NETWORKS AND CIRCUITS FOR ALARM SYSTEM OPERATIONS

(76) Inventor: Rick A. Britton, 3319 S. Saratoga, Springfield, MO (US) 65804

( * ) Notice: Subject to any disclaimer, the term of this patent is extended or adjusted under 35 U.S.C. 154(b) by 148 days.

(21) Appl. No.: 09/825,861

(22) Filed: Apr. 3, 2001

(65) Prior Publication Data

US 2002/0005781 A1 Jan. 17, 2002

Related U.S. Application Data

(60) Provisional application No. 60/194,432, filed on Apr. 4, 2000.

(51) Int. Cl.[7] ..... G08B 29/00

(52) U.S. Cl. ..... 340/506; 340/507; 340/541; 340/539; 348/153; 348/154; 701/301

(58) Field of Search ..... 340/506, 507, 340/541, 565, 539; 348/153, 154; 701/301

(56) References Cited

U.S. PATENT DOCUMENTS 4,361,740 A * 11/1982 Stockdale ..... 200/61.45 R
4,414,540 A * 11/1983 Dickenson ..... 340/508
4,630,110 A * 12/1986 Cotton et al. ..... 348/153
5,237,408 A * 8/1993 Blum et al. ..... 348/154
5,412,708 A * 5/1995 Katz ..... 348/14.05
5,717,379 A * 2/1998 Peters ..... 340/539
5,748,081 A * 5/1998 Lin ..... 340/555
5,996,023 A * 11/1999 Winter et al. ..... 709/253
6,040,770 A 3/2000 Britton ..... 340/539
6,069,655 A * 5/2000 Seeley et al. ..... 348/154
6,154,133 A * 11/2000 Ross et al. ..... 340/541

OTHER PUBLICATIONS

Web note for AVVID (Architecture for Voice, Video and Integrated Data) products of Cisco Systems, Inc., at URL= http://www.cisco.com/warp/public/779/largeent/avvid/products/infrastructure.html.

* cited by examiner

*Primary Examiner*—Daryl Pope
(74) *Attorney, Agent, or Firm*—Jonathan A. Bay

(57) ABSTRACT

Remote online utilization of video data for analyzing potential alarm events from an automatic alarm network includes the following. A premise-protecting control panel communicates with a sensor, providing a message in some or all cases of sensor signals. A remote receiver receives the messages of the control panel. A camera device is combined with the sensor for acquiring video data that allows further analysis into the matter of a given sensor-detected event. The camera device is configured with stateless network communication protocols and server processing to achieve network service of video data upon request. Correspondingly, the receiver is configured with compatible stateless network communication protocols and then also browser processing wherein the receiver can transmit network requests to the camera device for network service of said video data. The foregoing achieves remote online analysis of the video data in the matter of the given sensor-detected event.

14 Claims, 8 Drawing Sheets

| Seq. | Door | Sensor | Camera | Controller | VTR | Guard Shack having switched VMS |
|---|---|---|---|---|---|---|
| 0 | Closed | Active | Active | Armed | Off | ??? Likely switched to channels of other cameras. |
| 1 | Opens | Signals → | | Receives | | |
| 2 | | | | Responds → | On | |
| 3 | | | | Delays | | |
| 4 | | | | Signals → | | Alerted. |
| 5 | | | | | | Switches to this camera's channel. |
| 6 | | | | Receives ← | | Begins analysis, eg., send PZT commands, &c. |
| 7 et seq. | | | Responds ← | Relays | | Continues analysis. |

Client-Server model of
Network communications
in a Stateless protocol

*FIG. 7.*

*(PRIOR ART)*

Server CPU activities

| | | |
|---|---|---|
| 101 | Store minimal set of DLL objects | Secondary memory via DLLs |
| 102 | Store minimal Operating System | Secondary memory via DLLs |
| 103 | Store Application Source Program | Secondary memory via DLLs |
| 104 | Store Application Data Access programs | Secondary memory via DLLs |
| 105 | Store Network programs | Secondary memory via DLLs |
| 106 | Store Network Protocols | Secondary memory via DLLs |
| 107 | | |
| 108 | | |
| 109 | Store Application Data | Secondary memory via DLLs |
| 110 | Store Application First stage object with DLL references | Secondary memory via DLLs |
| 111 | Execute Operating System example Microsoft | Primary memory and Secondary memory via DLLs |
| 112 | Execute Network program using network protocols | Network card |
| 113 | | |
| 114 | Receive Request from Client | Network card |
| 115 | Analyze Request | Primary memory via DLLs |
| 116 | Select Requested Application First stage compile object and linked DLL object references | Primary memory and Secondary memory, via DLLs |
| 117 | Select Requested Data | Primary memory and Secondary memory, via DLLs |
| 118 | Transmit Requested Application First stage object with DLL references | Network card |
| 119 | Transmit Requested Application Data | Network card |
| 120 | | |
| 121 | | |
| 122 | | |
| 123 | | |
| 124 | | |
| 125 | | |
| 126 | | |
| 127 | Receive keystrokes/mouse clicks | Network card and Primary memory |
| 128 | Analyze keystrokes/mouse clicks | Primary memory via DLLs |

Client-Server model of
Network communications
in a Stateless protocol

*FIG. 8.*

*(PRIOR ART)*

Client CPU activities

| | | |
|---|---|---|
| 201 | Store DLL* Objects | Secondary memory via DLLs* |
| 202 | Store Full and complex Operating System | Secondary memory via DLLs* |
| 203 | | |
| 204 | Store Application Data Access programs | Secondary memory via DLLs* |
| 205 | | |
| 206 | Store Network program | Secondary memory via DLLs* |
| 207 | Store Network Protocols | Secondary memory via DLLs* |
| 208 | | |
| 209 | Store Requested Application Data set | Secondary memory via DLLs* |
| 210 | Store Application First stage object with DLL references | Secondary memory via DLLs* |
| 211 | Execute Operating System example Microsoft | Primary memory and Secondary memory via DLLs* |
| 212 | | |
| 213 | Execute Network program using network protocols | Network card |
| 214 | | |
| 215 | Send Request for program service | Network card |
| 216 | Receive Requested Application First stage object with DLL references | Network card |
| 217 | Receive Requested Application Data | Network card |
| 218 | | |
| 219 | Execute Application Second stage compile/interpretation to derive object and referenced DLL* | Primary memory and Secondary memory via DLLs* |
| 220 | Execute Derivative code | Primary memory via chip code |
| 221 | Execute Data access | Primary memory and Secondary memory via DLLs* |
| 222 | Develop Screen images with data content | Primary memory and Secondary memory via DLLs* |
| 223 | Translate Screen images example HTML, XML etc. | Primary memory and Secondary memory via DLLs* |
| 224 | Display Screen images | Video card |
| 225 | Collect keystrokes/mouse clicks | Interface card |
| 226 | Transmit keystrokes/mouse clicks | Network card |
| 227 | Store keystrokes/mouse clicks | Interface card, Primary memory |
| 228 | Analyze keystrokes/mouse clicks | Primary memory via DLLs* |

NETWORKS AND CIRCUITS FOR ALARM SYSTEM OPERATIONS

CROSS-REFERENCE TO PROVISIONAL APPLICATION(S)

This application claims the benefit of U.S. Provisional Application No. 60/194,432, filed Apr. 4, 2000.

BACKGROUND OF THE INVENTION

1. Field of the Invention

The invention relates to automatic, premise-monitoring alarm systems as for example burglary or burglary/fire alarm systems, and more particularly to network and circuit configurations for alarm system operations as will be apparent in connection with the discussion further below of preferred embodiments and examples.

2. Prior Art

Premise-monitoring alarm systems monitor a given protected premise—say, for example, a residential home, a commercial property, a bank vault, or an ATM machine and the like—for the occurrence of a given alarm event:—e.g., an unwanted intrusion, unauthorized entry or smoke and so on. Some alarm events simply correspond to a "low battery" condition in either the alarm-event sensors or else the protected-premise controller/control panel. Upon detection of a given alarm event, the controller signals the alarm event to a pre-determined receiving site(s), which traditionally has been a central alarm-monitoring station. In the traditional case, the central alarm-monitoring station, which may be a public or private service, may manually process the signal by an attendant who can dispatch police or fire-fighters or alert the property-owners or take whatever other steps are appropriate. Prior art automatic alarm systems have typically transmitted their message traffic over standard voice-grade telephone lines.

FIG. 1 shows an alarm system configuration 50 in accordance with the prior art. This alarm system configuration includes video surveillance by means of camera 52. In FIG. 1, the example protected premise features a certain door 54. This door may be assumed to be a front door to a bank lobby or the like. The door may see heavy traffic during business hours. But after closing time or later, perhaps this door is intended to lock out all but a highly select few who have been given pre-assigned privileges to use the door during the very latest hours.

FIG. 1 includes representation of a guard shack 56. For this bank, it keeps a security guard 58 posted at the shack perhaps twenty-four hours, all seven days of the week. Presumptively, the guard shack is the central receiving site for multiple other alarm controllers, although the drawing shows just one controller 60. Also, presumptively, each alarm controller 60 is linked with multiple sensors, although again the drawing shows just one sensor 62. The protection of this door 54 might be sensitive enough that it justifies video monitoring as well.

The upper half of FIG. 1 provides a sample event table. In this table, a typical sequence of events might comprise the following. At some original time, the door is closed, the controller is armed, the sensor and camera are active, and the guard shack is staffed by a given guard (eg., "user"). The guard shack is provided with a video monitoring system 64 which includes among other things, one or more monitors, a video tape recorder 66, and a switch 68. The switch is used as follows. Perhaps the guard shack has an array of monitors, but perhaps also the guard shack is linked with tenfold as many cameras 62 as it has monitors. These multiple other camera links are shown in the drawing by reference numeral 72 (although the other cameras are not shown). Thus the guard cannot perpetually monitor the channel of all the cameras simultaneously. The guard must flip between channels. Indeed, the VMS 64 is likely to have an automatic sequencer that sequences through the channels of all the relevant cameras. Alternatively, the guard can of course preempt the sequencer and tune in on the channel of a specified camera as the guard wishes. With the foregoing in mind, it is assumed that, at the original time when the door 54 is closed, the guard is switched to channels other than this camera 52 shown by FIG. 1.

At event no. 1, the door opens. The motion sensor 62 detects this event. It signals the controller 60 over a copper wire connection 74. At event no. 2, the controller has started its response. The controller sends a control signal to the local VTR 76 over copper wire 78 to begin recording. The local VTR 76 responds to the control signal and switches ON, however the VTR 76 is linked to the camera by co-axial cable 78. The controller 60 concurrently counts out its pre-set delay time. That is, authorized users might be given twenty (20) seconds to get through the door 54 and over to the controller 60 to enter a password or code. Without a timely entry of an authorized password or code, the controller at event no. 4 signals the guard shack of the prospective alarm event. The link between the controller and guard shack might be achieved by a standard voice grade telephone line 80.

At event no. 5, the guard switches into the channel of this camera. To tune into this camera 52, the guard shack switch must have a co-axial link 82/78 extending directly back all the way to the camera 52 (more accurately, there is a hop at the local VTR 76). Indeed, the switch might be fed the co-axial infeeds of dozens if not hundreds of other cameras. Again, such other infeeds are indicated by reference numeral 72. Logistically, such an expansive grid of co-axial cable 72/78/82 represents substantial resources in installation and maintenance. By event no. 6, the guard begins his or her analysis of the situation, including by transmitting instructions to the camera vis-a-vis the controller, such as pan, zoom, or tilt and so on (hereinafter more simply referenced as PZT). Event no. 7 et seq. show that further analysis continues, with the controller 60 relaying the guard's instructions to the camera. The guard has likely begun recording with the guard shack VTR 66 as well.

There are various shortcomings associated with the prior art configuration(s) of combined alarm monitoring and video surveillance. Installing and maintaining the co-axial cable is costly. Preferably, the guard shack is rather centrally located among the distributed cameras. Cost factors in many cases limit the serviceable distance between the guard shack and any of its cameras it services. There is little economy in having one guard shack in a region service diverse remote properties. The logistics of carrying video signals over co-axial cable virtually proscribe one guard shack per property. Also, once a guard shack site has been chosen, and wired up, it is costly to change that choice and move the guard shack. It is also costly to establish a redundant site(s) as for either back-up purposes or joint analysis purposes by users at various ones of the remote sites simultaneously.

Also, the video data travels over special co-axial cables whereas the command signals travel over other hardwired paths, but not the co-axial cables. Hence there are redundant paths extending between the camera and most devices it feeds video to and/or receives commands from.

Accordingly, it is an object of the invention to overcome these and other shortcomings of the prior art and provide improved networks and circuits for alarm system operations. Additional aspects and objects of the invention will be apparent in connection with the discussion further below of preferred embodiments and examples.

SUMMARY OF THE INVENTION

It is an object of the invention to provide remote online utilization of video data for analysis of potential alarm events.

It is another object of the invention to merge IP telephony with premise-protecting control panels that only have voice-grade aural signal communication ability.

It is an alternate object of the invention to provide remote consolidated printer services to a distributed community of premise-protecting control panels.

It is an additional object of the invention to provide remote panel programming capability from anywhere a network connection can be made and thereby service any of the distributed community of premise-protecting control panels.

It is yet another object of the invention to provide a 2-way radio link between a given battery-powered alarm-event sensor and a given premise-protecting control panel in order to cut down the signal emissions from the sensor and thereby save the drain on battery power.

These and other aspects and objects are provided according to the invention in a method of remote online utilization of video data for analysis of potential alarm events in an automatic alarm system. This last-mentioned method comprising aspects of the following. At least one sensor is provided on a protected premise with a signal response in cases of sensing a sensible event. At least one premise-protecting control panel is in communication with the sensor and provided with a message response in some or all cases of sensor signals. At least one remote receiver is provided for receiving the message traffic of the control panel.

An inventive aspect relates to providing at least one camera device in combination with the sensor for acquiring video data allowing further analysis into the matter of a given sensible event. A communications network allows linking at least the camera device and receiver for communications. The camera device is configured with stateless network communication protocols and server processing wherein the camera device provides network service of video data upon a network request. Correspondingly, the receiver is configured with compatible stateless network communication protocols and then also browser processing wherein a user at the receiver can transmit network requests to the camera device for network service of said video data. The foregoing achieves remote online analysis of the video data in the matter of the given sensible event.

Preferably the stateless network communication protocols can be chosen from open protocols including HTTP. That way, the communications network may include at least in part the Internet. This method of online utilization of video data allows a plurality of remote user sites to link up to the network and thereby request network service of the video data by communicating at least in part over the Internet. The network requests submitted by the receiver (or any of the remote users) can include pan, zoom and tilt instructions. The camera and sensor may either be different devices or the same device.

Additional aspects and objects of the invention will be apparent in connection with the discussion further below of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

FIG. 7 is a table of server-side CPU activities in accordance with the prior art for a server participating in the prior art client-server model of network communications in a stateless communications-transfer protocol (eg., Web); and, FIG. 8 is a table of client-side CPU activities in accordance with the prior art for a client participating in the prior art client-server model of network communications in a stateless communications-transfer protocol (eg., Web).

DETAILED DESCRIPTION OF THE PREFERRED EMBODIMENTS

Figure 2:
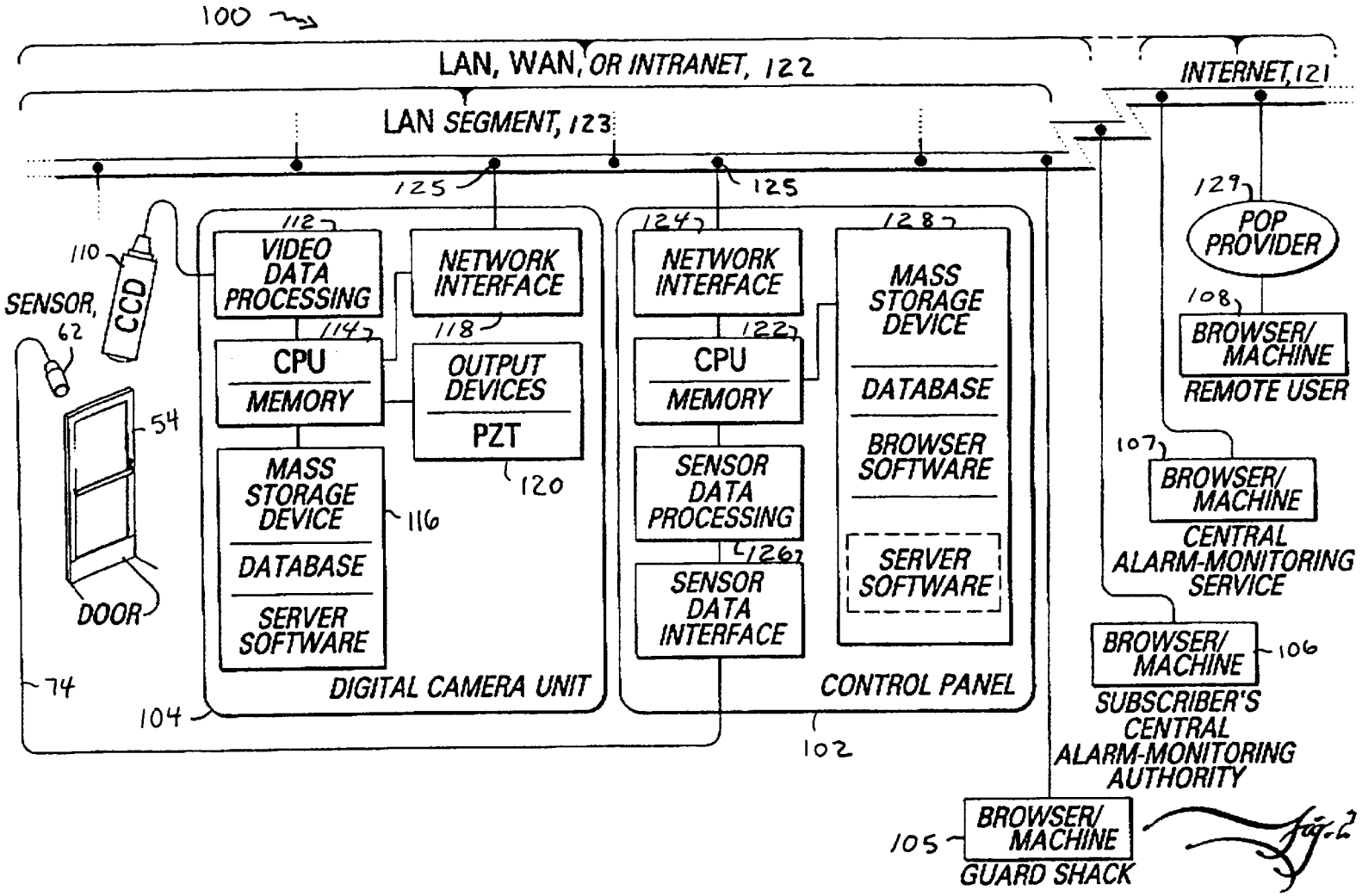
FIG. 2 is a diagrammatic view of an alarm system combined with video surveillance in accordance with the invention.

FIG. 2 gives a diagrammatic view of an alarm system 100 combined with video surveillance in accordance with the invention. A control panel 102 in accordance with the invention is situated among an array of cameras (only one camera 104 shown by the drawing) are linked by browser/server technology as will be discussed more particularly below in connection with FIGS. 6 through 8. The control panel is connected with any of various receiving sites 105-08 for its message communications by users likewise implemented with browser/server technology.

The control panel, camera and the remote receiving sites 105-08 can be linked up in various configurations including what may be referred to as inter-networking. The term "inter-networking" has apparently evolved to encompass the networking of networks, including where one such network might be the Internet global computer network.

Figure 1:
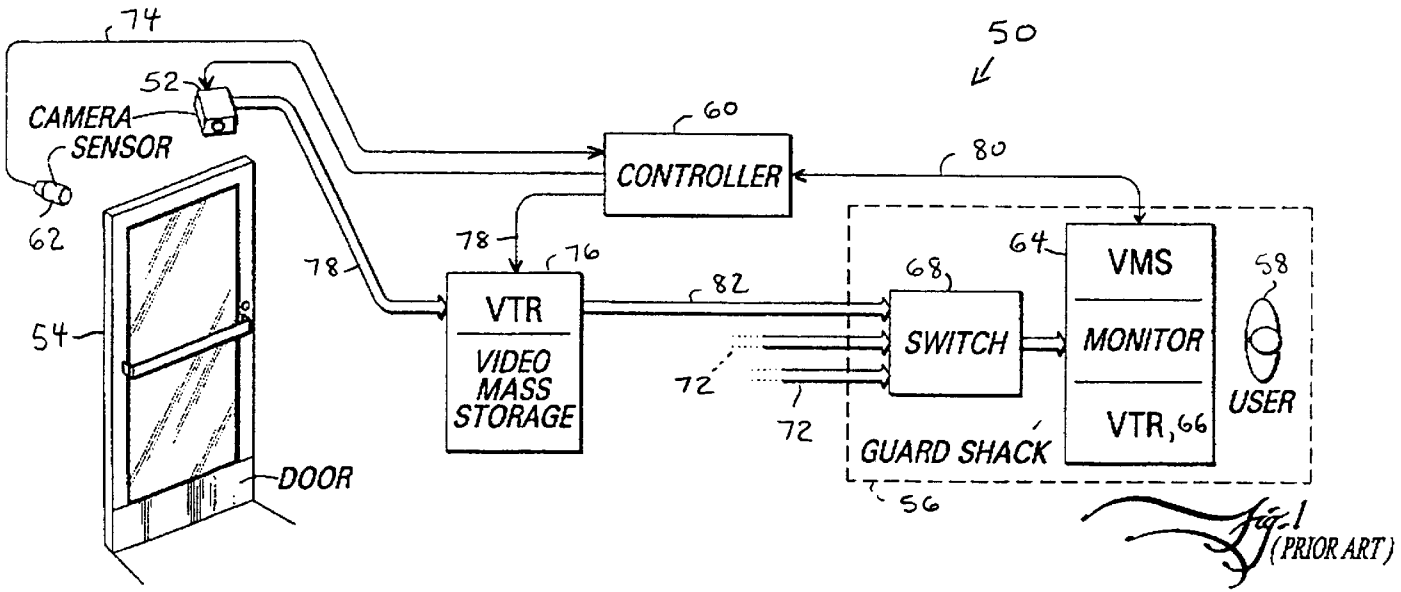
Fig. 1 (PRIOR ART)
FIG. 1 is a diagrammatic view of an alarm system combined with video surveillance in accordance with the prior art, including a sample event table to give an example sequence of events for such an alarm/video surveillance system in operation.

FIG. 2 shows the door 54 as comparably shown by FIG. 1, under the monitoring of a sensor 62 linked with the inventive control panel (only one sensor shown of what typically would include many). The drawing shows the sensor and control panel hardwired together, although FIG. 5 will show an alternate embodiment where the sensor and control panel communicate by radio.

Video surveillance is achieved by the digital camera unit 104, such as what are available from for example, SONY® and others. The digital camera unit comprises a charge-coupled device (CCD) 110 feeding a digital signal processor, identified as video signal processing 112 in the drawing. The camera unit incorporates a processor 114 with memory for various processing functions described more particularly as follows. The camera unit also includes a "mass" storage device 116 which, despite being generically referred to as "mass," may provide only a modest amount of storage capacity. The mass storage device may comprise one (or just a portion of one) chip, or alternatively multiple chips, or else perhaps a local disk or drive. The mass storage device provides for storage of server and communication software, and perhaps optionally for database storage of limited amounts of video data. The camera unit can be linked to a network by the provision of a network card 118 or the like, and also has various output functions 120 including significantly, the drives for the pan, zoom, tilt (PZT) functions.

The inventive control panel is shown in an abbreviated format. What is shown includes a processor and memory 122, a network card 124, an interface and card 126 for processing sensor signals, as well as its own mass storage device 128. The control panel's mass storage device likewise provides storage for programming including browser software as well as providing storage for data. Additionally, the mass storage device provides storage for server software as will be more particularly described below in connection with FIG. 4. Whereas the mass storage aspect is again referred to as a "device," it might actually be realized as a set of chips instead of a single (or portion of one) chip, or else a disk or drive (or tape and so on).

An inventive aspect of this FIG. 2 inter-networking configuration includes attaching the camera unit and control panel on a network 121-23. FIG. 2 shows the camera unit and control panel linked to the same segment 121 of a LAN 122 (ie., local area network). In a preferred embodiment of the invention, the LAN comprises an Ethernet® network segment 123 having predominantly a bus topology. However, the invention could be achieved using other network protocols configured in other topologies including ring, star, and/or combinations of any of bus, ring or star topologies. The camera and/or control panel might actually link to the LAN segment at a point of access 125 by means of, among other means, a hub. Whereas the drawing shows just one device attached to each point-of-access or hub 125 on the bus 123, it's more likely that this particular camera and control panel would hang off the same hub. The camera and control panel (or a connected input device like a card reader or keypad, not shown) would likely be physically relatively close together since both are close to the door:—ie., the camera to view it, and control panel (or more simply the input device, not shown) to afford a walk-in party the opportunity to walk over to the control panel (or the input device as card reader or keypad and so on) within the allotted delay time (eg., 20 seconds or so). Hence for convenience sake, the camera and control panel (as well as, though not shown, the various other of the array of cameras and input devices serviced by the control panel) can attach to the LAN by the same hub 125 (although this is not shown).

What the drawing shows as a LAN segment 123 might more simply represent one entire LAN. However, denoting the LAN segment 123 as such a segment 123 accommodates clustering. For example, if this LAN segment is owned by a geographically distributed banking enterprise, the bank might distribute its inter-networking configuration to cluster together certain sub-units of its operation. That is, a given bank lobby and its proximate ATM machines (not shown) might be networked by the LAN segment 123 as shown, the larger banking enterprise within a metropolitan area might tie in several LAN segments into one LAN (eg., 122), the bank's LAN's across the nation being networked together in a WAN (ie., wide area network, again, 122), all which might interface at several points with the Internet global computer network 121.

The camera unit 104 is provided with server-implemented communication abilities. The control panel 102 is provided with complementary browser-implemented communication abilities. Briefly stated, the camera and browser can communicate with each other over the network 121-23. Also, since the video data is digital, the video data can likewise travel over the network 121-23 rather than over special co-axial cables. Hence both the video data as well as message data travel over the same pathway, ie., the network paths 121-23. Moreover, the control panel can store a certain amount of the video data onboard in its own mass storage device 128. The control panel 102 need not have a video tape recorder. A further advantage is that the control panel can be provided with analysis software that captures frames, and then perhaps "analyzes" or compares an earlier to a frame for differences, ie., which corresponds to motion detection analysis.

Referring back to the event table of FIG. 1, a comparable sequence of events might transpire with the FIG. 2 system in accordance with the invention as follows. At an original time, the door 54 is closed. At event no. 1, the door opens, and the sensor 62 signals the control panel 102. At event no. 2, the control panel responds by counting down the delay time as well as requesting the camera 104's server to serve browser-formatted video data to the control panel. If no appropriate password is inputted by the end of the delay period, then the situation has evolved into a prospective unauthorized intrusion. The control panel can signal any "guard" 105-08, wherever he or she may be found, of the unwanted intrusion.

This FIG. 2 configuration of an alarm system changes the whole paradigm of a "guard" shack. A "guard" 105-08 can effectively perform his or her duty wherever access may be had to a browser-implemented machine. FIG. 2 shows several possibilities among others. There may actually still be a guard "shack" or post 105 somewhere within the ambit of the same LAN segment. Alternatively, the guard may be any remote user 106-08 alerted by the control panel's signal from anywhere on the wider network including from the dominant LAN 122 or the WAN 122 or the like. The "guard" may be physically found about anywhere. A further inventive aspect of this configuration is that a "guard" 105 (say, in the guard post) and another user (any of 106 through 108) in a remote other location might concurrently submit browser requests to the camera 104's server for video. This allows concurrent analysis by the guard 105 on the spot as well as a relevant party 106-08 from further afield. More simply, it allows about any combination of relevant parties 105-08 to access the camera 104's and control panel 102's data from about anywhere.

FIG. 2 shows the following other remote users. FIG. 2 shows an instance of the bank (ie., the subscriber) having its own chief security authority 106 (as, eg., in a headquarters building elsewhere) connected by the bank's Intranet or WAN 122. The bank may also subscribe to a private service 107 for alarm monitoring services, which may be connected by its own Internet Access Point directly to the Internet backbone 121. In fact, this configuration supports numerous other remote users 108 (one shown), one which for example might be the bank's chief security officer 108 who, from his home at night as linked to the Internet 121 by a Point-of-Presence provider 129 as shown, joins the action with the guard 105 and/or other staff 106/107 in analyzing the available data. Simply put, once the data is served vis-a-vis the point-of-access 125 to the network 121-23, the data can be browsed from about anywhere.

Figure 3:
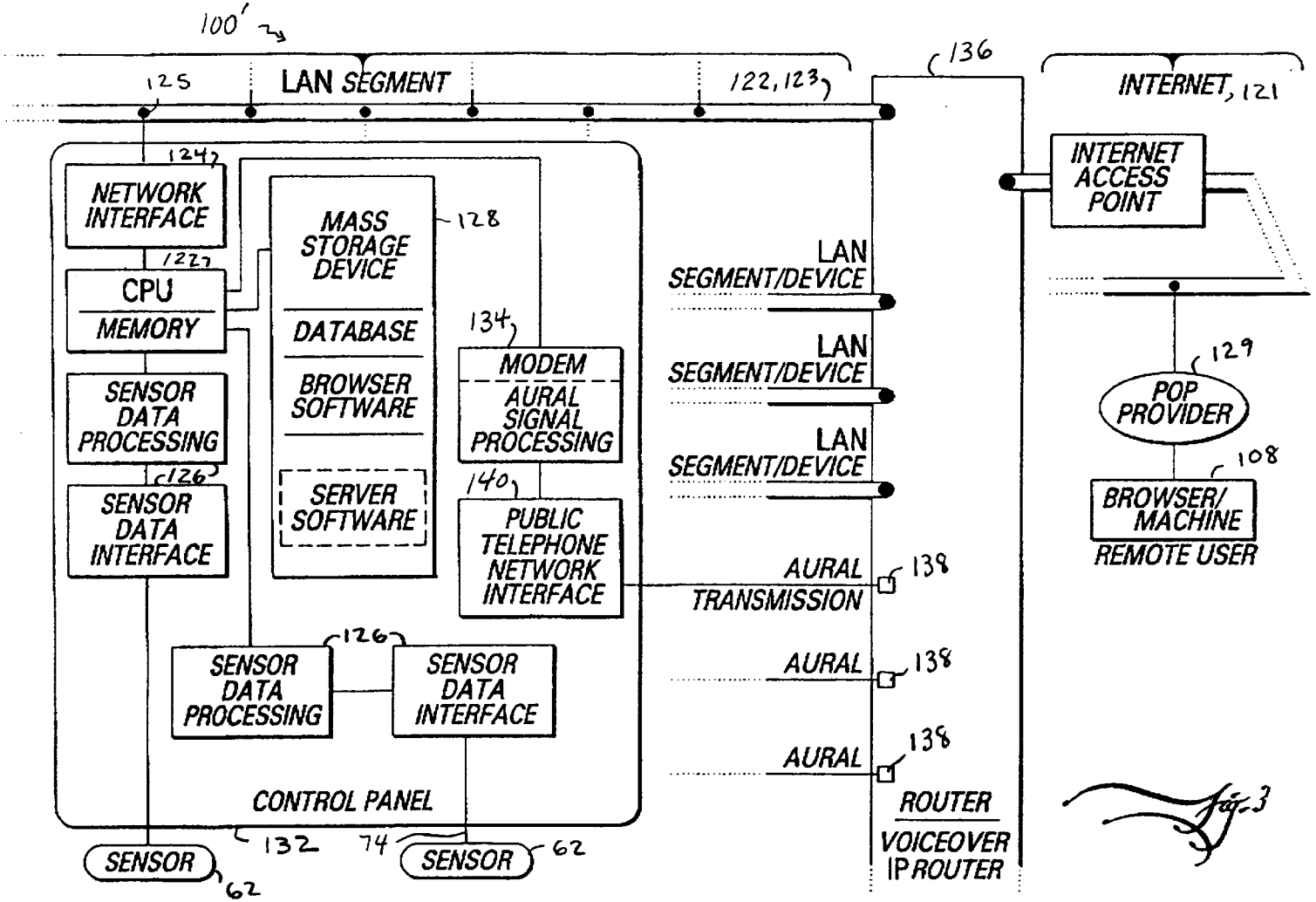
FIG. 3 is a diagrammatic view of communication path integrity supervision in accordance with the invention in a network system for alarm system data communication.

FIG. 3 shows a variant of the FIG. 2 configuration. In FIG. 2, all the message communication is presumed to transpire in accordance with one network protocol or another. For example, the LAN protocol might be formatted by an Ethernet® protocol while other parts of the transmissions would more likely take the format of IP and/or IP/TCP protocol(s), which is especially likely for Internet transmissions. However, within the alarm system industry, alarm message communication has formerly been handled predominantly by standard voice-grade telephone lines.

More to the point, there are thousands upon thousands of control panels already in existence, installed and in use around the country that operate predominantly by means of standard voice-grade aural communications, whether actually transmitted over landlines or by cellular links. Commonly-owned, commonly-invented U.S. Pat. No. 6,040,770—Britton, and its co-pending continuation, U.S. application Ser. No. 09/524,166, filed Mar. 13, 2000, discloses various schemes of integrity supervision for alarm data communication. In the ordinary case, such alarm data communication is formatted for voice-grade aural communications, whether by landlines, cellular links or other long-range radio links.

FIG. 3 shows the merging of voice-grade aural communications with IP telephony equipment. FIG. 3 shows an alternate embodiment 132 of the control panel 122 shown by FIG. 2. Whereas this control panel 132 has a network card 124 and point-of-access 125 connection to the LAN segment 123 as shown by FIG. 2, this control panel 132 retains the standard aural processing circuitry 134 that has long been used by the industry.

The control panel 132 is connected to a router device 136 which includes interfaces 138 for voice-grade aural transmissions. This router device 136 is further of the type that implements IP telephony. Such routers are provided by many OEM's including by way of non-limiting example the products of Cisco Systems, Inc., which utilize the Cisco AVVID architecture (ie., architecture for voice, video and integrated data). See, for example, http://www.cisco.com/warp/public/779/largeent/avvid/products/infrastructure.html.

That way, the alarm data communication over the network 121-23 can dispense with the control panel 132's network card 124 and rely instead on the connections out of the control panel 132 from the public-telephone-network interface 140. Instead of plugging into the public telephone network, the control panel 132 is linked to the telephony ports 138 on the voiceover IP router 136 by a phone wire 142 out of the public-telephone-network interface 140. A remote user 108 having a browser can communicate over the Internet with the control panel 132, all as by means of IP telephony. Hence, the aural transmissions of the control panel 132 are in fact transmitted over the Internet 121 in browser format. However, the remote user 108's browser software decodes the browser format back into aural transmission format. Hence the remote user 108's machine can utilize the integrity supervision protocols disclosed by the above-referenced patent disclosure(s) of Britton.

Hence the FIG. 3 arrangement(s) 100[1] provide(s) the following advantages. Long distance telephone charges over the Internet are cheap, compared to calls over telephone lines or cellular links. One aspect of the integrity supervision (eg., as disclosed by the above-referenced patent disclosures of Britton) involves periodic communications to or from the dispersed control panels to check each panel's present capability of sending alarm signals. The cost of long distance tolls can be costly over the public telephone network. In fact, sometimes the integrity supervision scheme is designed to wait long periods between check-in calls in order to economize on long-distance tolls. However, with cheap long distance over the Internet, there is no longer any need to keep the check-in messages infrequent. Indeed this encourages having the check-in messages checking "in" more frequently because greater frequency equates with superior integrity assurance.

Also, the FIG. 3 arrangement 100[1] merges the advantages of having the Internet 121 carry the alarm data communications with the fact that the much of the existing control panels already out in the field are not network-card enabled but, reliant on aural transmission technology 134/140. Briefly stated, FIG. 3 merges aspects of the new (eg., the Internet 121 or networking protocols 122-23) with aspects of the old (eg., aural transmission formats 134/140).

Figure 4:
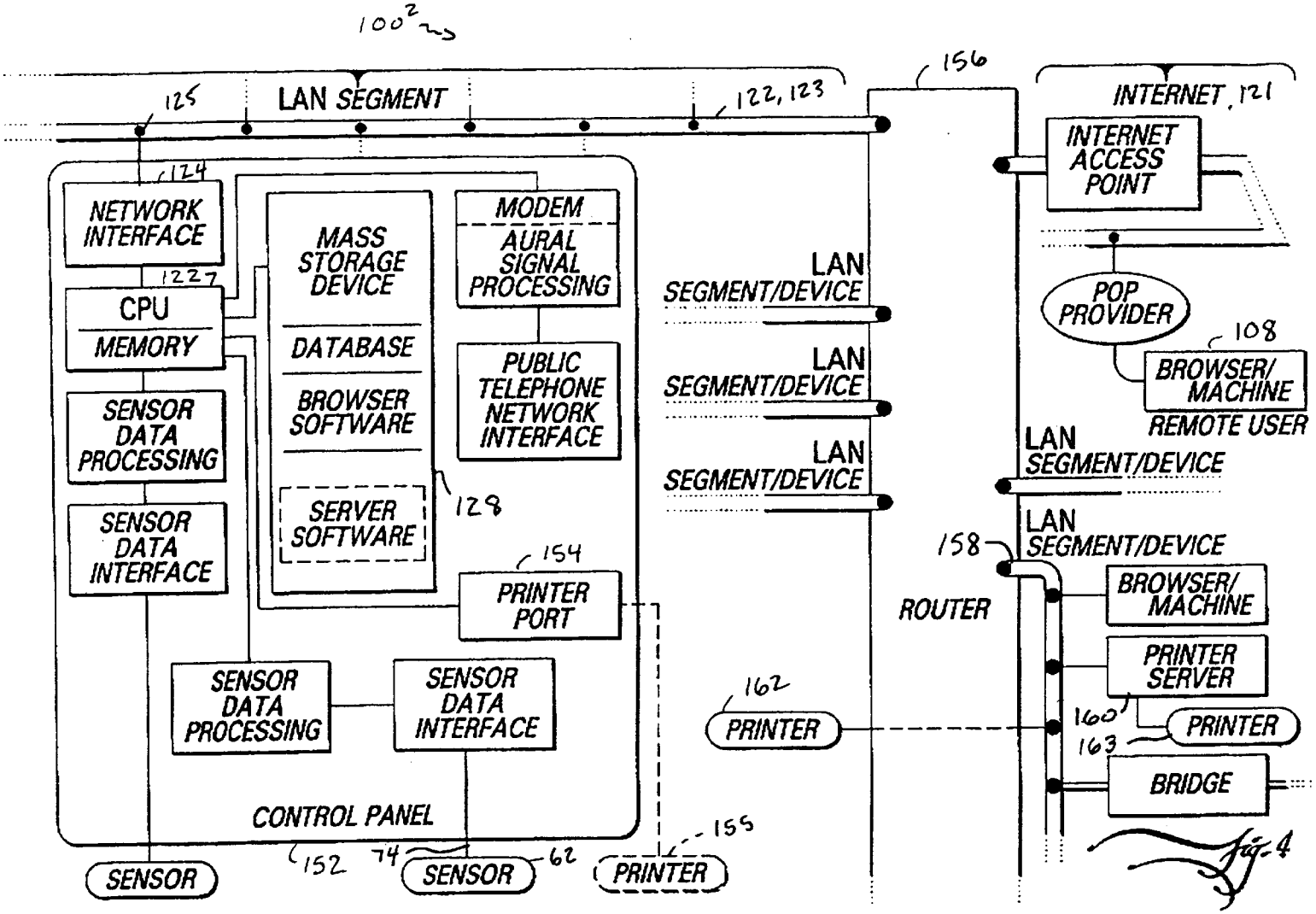
FIG. 4 is a diagrammatic view of an inter-networking configuration of an alarm system for report printing facilities in accordance with the invention as well as control panel programming in accordance with the invention.

FIG. 4 shows inventive aspects relating both to report printing as well as control panel programming. In regards of report printing first, to date, various control panels are configured with a printer port.

The control panel 152 shown by FIG. 4 has such a printer port 154. Its printer port 154 allows a direct wire connection to be extended to a nearby printer 155 for report printing purposes. However, this control panel 152, being comparable to the FIGS. 2 and 3 control panels 102 and 132, is provided with network interface 124. The control panel 152 is linked by point-of-access or hub 125 to the LAN segment 123. The LAN segment 123 includes a terminus in a router 156. For sake of illustration, the router 156 is shown having all manners of network devices and/or segments hanging off it. More relevant to the present description of printer utilities, the router has another LAN segment 158 extending off it which links to both a printer server 160 in one instance as well as a stand-alone printer 162 in another instance. Given the foregoing, the report printing transmissions for any given control panel 152 on the network 121-22 can be routed over the network 122-23 to any network printer 162-63. Hence the foregoing obviates the need of directly linking each control panel 152 to a printer (eg., 155) by the printer port 154 on the control panel 152. Hence the printer 155 that is directly connected to the control panel 152 is no longer necessary. Accordingly, this printer 155 is shown in dashed lines in the drawing for this reason.

To return to the matter of control panel programming, the control panel 152 is configured with server software as well as browser software. The prior art way of programming a control panel has involved the following. Perhaps a laptop computer (not shown) was brought to the control panel and connected to it by a serial port. The producer/manufacturer of the control panel might likely provide proprietary software for programming the control panel. Such proprietary software would be installed on the laptop. From the laptop, a user would program the control panel. Control panel programming would address the following matters. For example, with reference to FIG. 2, the control panel 102 might be programmed with the instruction that 'once entry has been detected through the front door, delay twenty (20) seconds before branching to the next action.' Certainly the portion of that instruction regarding the twenty (20) second delay can be changed to other values by programming. Another instruction might recite in effect, 'in the absence of an intervening input of a valid password, the next action will be both send a transmission to a certain receiver site 108 as well as sound a siren.' Other instructions would include the establishment of user accounts, passwords and codes and the like, and so on. In the drawings, no such laptop is shown.

An inventive aspect of the FIG. 4 arrangement $\mathbf{100}^2$ is that it eliminates the need for physically transporting a laptop or other portable device to the control panel 152 for programming. The programming tasks can be achieved by the remote user 108 who through his or her browser has the control panel 152's server serve its settings to the user 108. The user 108, if authorized, can then change the settings or programming of the control panel 152. Again, the foregoing is achieved by installing the control panel 152 with server software. It turns out that the memory 128 and processing 122 requirements for handling the server software is surprisingly small. The server package is transparent to both the relatively latest versions of NETSCAPE NAVIGATOR® and MICROSOFT IE® browsers. However, the server package is not elaborate, and utilizes the least common denominator factors in its composition to keep things simple and as shown and described more particularly next in connection with FIGS. 6 through 8.

Figure 6:
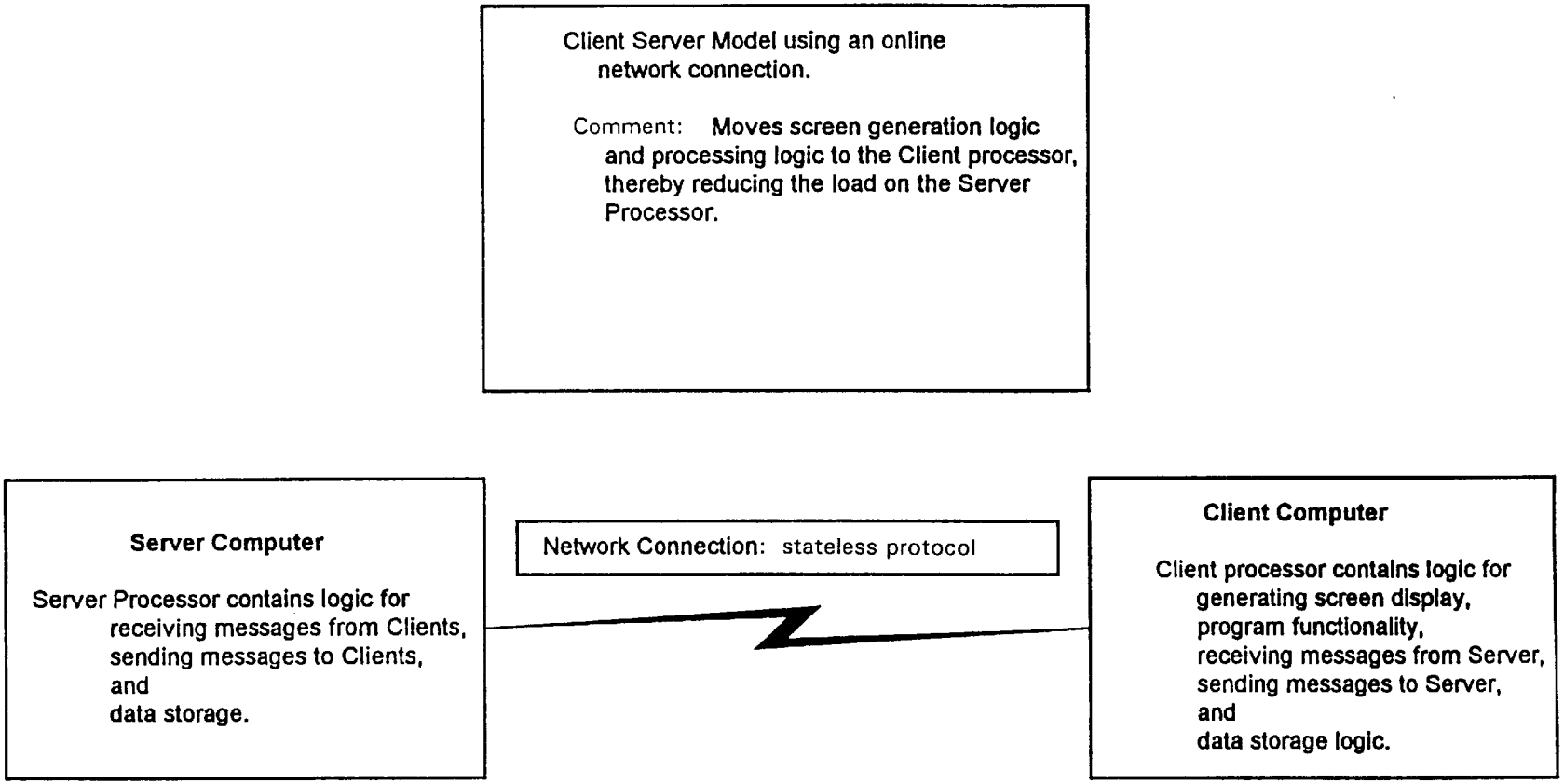
FIG. 6. (PRIOR ART)
FIG. 6 is a block diagrammatic view of the client/server model in accordance with the prior art for network communications between server(s) and client(s) in a stateless communications-transfer protocol such as famously implemented by the World Wide Web.

FIG. 6 is a block diagrammatic view of the client/server model in accordance with the prior art for network communications between server(s) and client(s) in a stateless communications-transfer protocol such as famously implemented by the World Wide Web. FIG. 7 is a table of server-side CPU activities in accordance with the prior art for a server participating in the prior art client-server model of network communications in a stateless communications-transfer protocol (eg., the Web) as shown by FIG. 6. FIG. 8 is a corresponding table of client-side CPU activities in accordance with the prior art for a client participating in the prior art client-server model of network communications in a stateless communications-transfer protocol (eg., as the Web).

As well understood by those skilled in the art, computers communicating over the World Wide Web ("Web") do so by browser technology and in an environment described as a "stateless" or non-persistent protocol. "Intranet" generally refers to private networks that likewise implement browser technology. "Internet" generally includes the Web as well as sites operating not on browser-technology but perhaps maybe servers of mail or Internet chat and the like. At least in the case of the Web, the stateless protocol is denominated as Hypertext Transfer Protocol ("HTTP").

One premise of the Web is that material on the Web may be formatted in open or "public domain" formats. These principally include to date for Web-page matter the languages or formats of HTML (hypertext markup language), SGML (standard generalized markup language), XML (extensible markup language), XSL (extensible style language), or CSS (cascading style sheets). Many if not most of these open formats are produced under the authority of W3C, which is short for World Wide Web Consortium, founded in 1994 as an international consortium of companies involved with the Internet and the Web. The organization's purpose is to develop open standards so that the Web evolves in a single direction rather than being splintered among competing factions. The W3C is the chief standards body for HTTP and HTML and so on.

On the Web, all information requests and responses presumptively conform to one of those standard protocols. Another premise of the Web is that communications vis-a-vis requests and responses are non-persistent. A request comprises a discrete communication which when completed over a given channel is broken. The response thereto originates as a wholly separate discrete communication which is afforded the opportunity to find its way to the requestor by a very different channel.

FIG. 6 shows aspects of the prior art client/server model for network communications between a server and a client. Those ordinarily skilled in the art well understand that this prior art model takes advantage of distributed computing on a large even global scale. This involves a network of user machines (PC's, laptops, even microprocessors) connected via moderate bandwidth, low-latency networks which as a whole cooperate as a computing platform. The goal has been to take advantage of a large resource pool of machines comprising hundreds of gigabytes of memory, terabytes of disk space, and hundreds of gigaflops of processing power that is often idle. This paradigm in computing was expected to impact the fundamental design techniques for large systems and their ability to solve large problems, service a large number of users, and provide a computing infrastructure. Hence substantial amounts of screen generation logic as well processing and data manipulation logic is moved onto the user machines. This reduced the load on the server processor by distributing the processing load among the users.

FIGS. 7 and 8 show that much of this functionality is implemented by software-object libraries store the Dynamic Link Library objects (eg., DLLs). For example, on a Microsoft® operating system, these objects take the *.dll extension. DLLs provide a call to oft-used functionality. Microsoft provides standardized packages of DLLs in order to provide a consistent computing platform between machines transferring communications over a network.

FIG. 7 provides a table of prior art server-side CPU activities for a server practicing the prior art client/server model for network communications of FIG. 6. Activity 102 recites that a minimal operating system gets loaded into secondary memory (eg., hard-drives) by processes that use DLL'S. Activity 110 recites that the application program undergoes a first-stage compile process calling to produce a first-stage object with DLL references, which gets stored on secondary memory.

FIG. 8 provides a table of prior art client-side CPU activities for a client participating in the prior art client/server model for network communications of FIG. 6. Activity 219 recites that the requested first-stage object with DLL references undergoes a second-stage compile/interpretation process to derive an object and references to the DLLS* on the client machine. The DLLS* on the client machine are asterisked because there are potential differences between the DLLs on the server and the corresponding DLLS* on the client machine. Activity 220 recites that the client machine executes the derivative code so derived.

In general, in cases if the client is any of the parties 105 through 108 of FIG. 2 (eg., guard shack 105 and/or any of the other alarm-monitoring parties 106-108), then the client is able to communicate with a server (for example either the control panel 102 or camera unit 104) by doing the following. Briefly stated, the client connects to the server machine (eg., control panel 102 or camera unit 104) and:

requests the server's data on the prospective alarm event, performs observation and analysis activity, and enters results of the analysis.

More particularly, the CPU of the client (eg. guard shack 105 and/or any of the other alarm-monitoring parties 106-108 of FIG. 2) will:

connect to server/camera, accept keystrokes/mouse inputs (ie., there from the client's machine), analyze for forming a request, transmit the request to the server/camera, receive the First-stage Object and referenced DLLs, receive the requested data, execute the Second stage compile/interpretation of the object and referenced DLL'S, develop the screen and screen content display the developed screen, accept further keystrokes/mouse inputs (again, from the client's machine), analyze keystrokes/mouse inputs, and either build another different screen, or Transmit a request to server/camera for additional Data and First stage objects and DLL references, and so on continuing the process.

All of the above example could be executed with two or three requests to the Server CPU (depends on program design). All the above activity preferably takes place within the Client CPU. That way, the server gets by on operating on a limited operating system and other programming functionality/instruction set.

Figure 5:
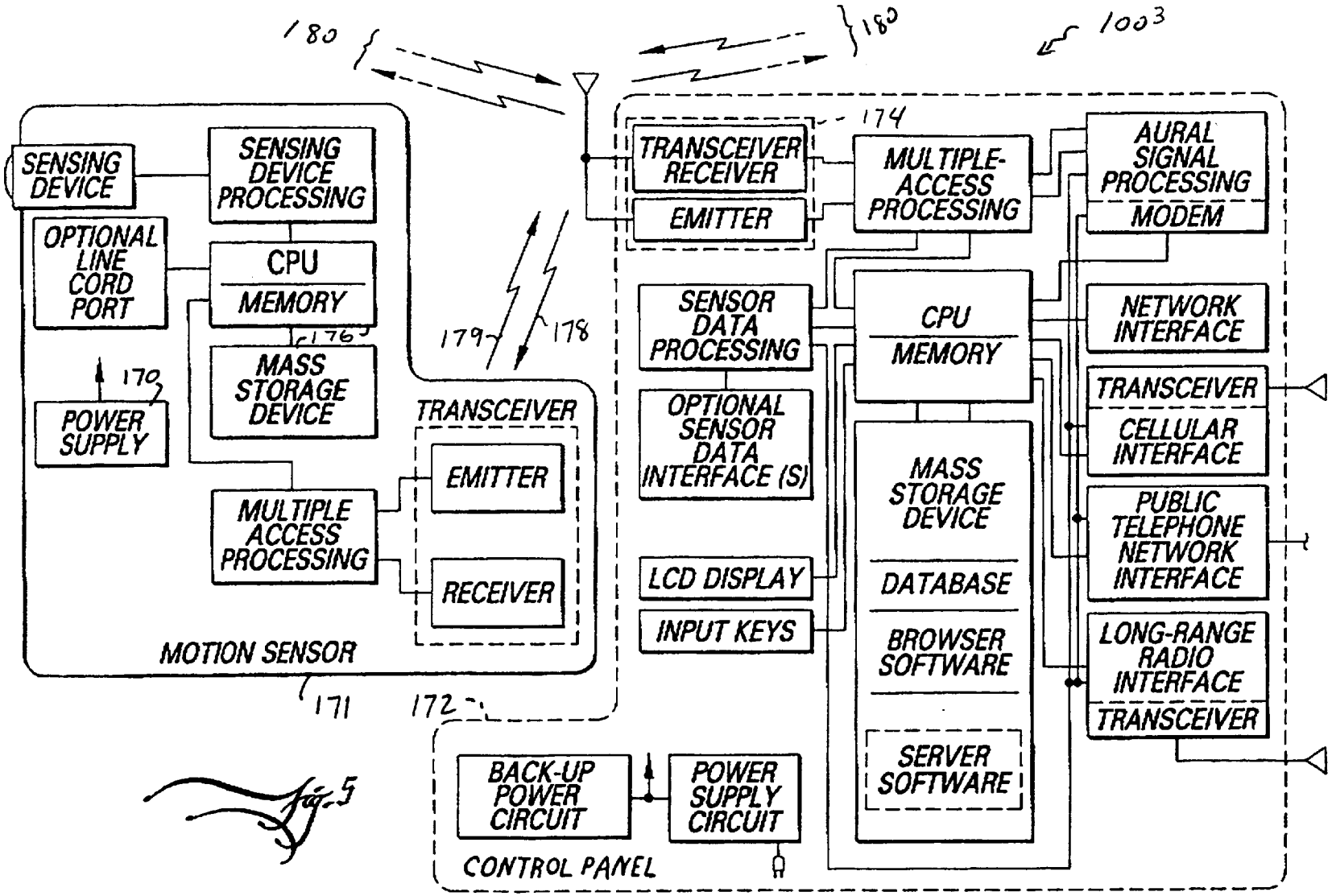
FIG. 5 is a diagrammatic view of communication path integrity supervision in accordance with the invention between a control panel and a battery-powered sensor.

FIG. 5 shows a further aspect 100[3] of the invention. In the past, communication between any of the sensors and their dominant control panel has been configured for radio. However, this has been limited to one-way transmission from the sensor to the control panel. One reason to use a radio link was to eliminate the need for a physical wire 74 to extend between the sensor 62 and control panel 102. A related development with this was to power the sensor off batteries 170. That way, such a battery-powered sensor 171 was entirely independent of wiring either to the control panel 172 or to public utility power.

However, as stated, to date there has only been one-way transmission from the sensor to the control panel. Thus, the state of matters may be referred to as one-way wireless transmission in a battery-operated unit. An advantage of this includes that such battery-operated sensors are miniature and can be placed in the most hidden away locations.

A disadvantage has been found with the following. The greatest drain on the battery occurs with transmission. The present preferred mode of one-way transmission has the sensor sending its signal perhaps as many as twenty (20) times in a row to insure that the control panel received the signal.

The invention 100[3] in accordance with what is disclosed by FIG. 5 provides two-way wireless transmission between the sensor 171 and control panel 172. The control panel 172 shown by FIG. 5 is comparable to the version 152 shown by FIG. 4 except including among other things, a transceiver set 174 of a receiver and emitter for radio communication with the sensors (only one sensor 171 shown in the drawing). Additionally, the sensor 171 is provided with a minimal amount of processing power 176. This enables the sensor 171 to respond to low-level programming instructions. The foregoing will be more particularly described next.

Thus two-way transmission provides multiple advantages. For one, the control panel 172 can feed back the sensor 171 a "received" signal 178 when indeed a sensor's signal 179 is received. The "received" signal 178 can signify the sensor 171 to stop. That way, the sensor 171 need not re-transmit a signal 179 twenty (20) times in a row blindly, not ever knowing if the control panel 172 got the signal 179 on the first transmission, if at all. Presumptively, the control panel 172 will indeed receive the signal 179 in the first set of transmissions or so. Hence the sensor 171 will be stopped from wasting its battery power on many redundant needless transmissions of signal 179. Consequently, this will prolong the use life of the battery 170.

Furthermore, the control panel 172 can download various programming instructions to the sensor 171. For example, the control panel 172 might instruct the sensor 171, as in pseudo-code, 'front door sensor 171, we are disarmed until notified next' (eg., for the duration of business hours or the next nine (9) hours or so). Then later, the control panel 172 would likely re-instruct the sensor 171, again in pseudo-code, 'front door sensor 171, we are now armed, so check-in on a regular schedule of every ten (10) minutes.' No doubt the nine (9) hours of downtime saves the life of the battery 170. Alternatively, the control panel 172 might recite to a different sensor (no other sensor shown, although various other radio links 180 are shown), 'you are afire detector, so call back with a check-in message each minute.' Those are just examples of the various matters likely to be addressed between the control panel 172 and its dependent sensors 171.

Therefore, the two-way wireless transmission both provides the control panel 172 with more intelligent management of its dependent sensors 171's battery resources.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A method of remote online utilization of video data for analysis of potential alarm events in an automatic alarm system, comprising the steps of:

providing at least one sensor on a protected premise with a signal response in cases of sensing a sensible event;

providing at least one premise-protecting control panel in communication with the sensor with a message response in some or all cases of sensor signals;

providing at least one remote receiver for receiving the message traffic of the control panel;

providing at least one camera device in combination with the sensor for acquiring video data allowing further analysis into the matter of a given sensible event;

providing a communications network for linking at least the camera device and receiver;

configuring the camera device with stateless network communication protocols and server processing wherein the camera device provides network service of video data upon a network request; and, configuring the receiver with compatible stateless network communication protocols and browser processing wherein a user at the receiver can transmit network requests to the camera device for network service of said video data and thereby achieve remote online analysis of the video data in the matter of the given sensible event.

2. The method of claim 1 wherein the stateless network communication protocols can be chosen from open protocols including HTTP.

3. The method of claim 2 wherein the communications network includes at least in part the Internet.

4. The method of claim 3 further comprising a plurality of remote user sites linked for requesting network service of the video data by communicating at least in part over the Internet.

5. The method of claim 1 wherein the network requests submitted by the receiver can include pan, zoom and tilt instructions.

6. The method of claim 1 wherein the camera and sensor are either different devices or the same device.

7. A method of remote online utilization of video data for analysis of potential alarm events in an automatic alarm system of the type having:

at least one sensor on a protected premise which has a signal response in cases of sensing a sensible event, at least one premise-protecting control panel in communication with the sensor which has a message response in some or all cases of sensor signals, at least one remote receiver for receiving the message traffic of the control panel, at least one camera device in combination with the sensor for acquiring video data allowing further analysis into the matter of a given sensible event, and a communications network for linking at least the camera device and receiver, wherein the camera device is configured with stateless network communication protocols and server processing such that the camera device provides network service of video data upon a network request, said method comprising the steps of:

configuring the receiver with compatible stateless network communication protocols and browser processing wherein a user at the receiver can transmit network requests to the camera device for network service of said video data and thereby achieve remote online analysis of the video data in the matter of the given sensible event.

8. The method of claim 7 wherein the stateless network communication protocols can be chosen from open protocols including HTTP.

9. The method of claim 8 wherein the communications network includes at least in part the Internet.

10. The method of claim 9 further comprising a plurality of remote user sites linked for requesting network service of the video data by communicating at least in part over the Internet.

11. The method of claim 7 wherein the network requests submitted by the receiver can include pan, zoom and tilt instructions.

12. The method of claim 7 wherein the camera and sensor are either different devices or the same device.

13. A method of utilizing IP telephony with premise-protecting control panels in an automatic alarm network of the type in which the control panels are configured with voice-grade aural signal processing, comprising the steps of:

providing at least one sensor on a protected premise with a signal response in cases of sensing a sensible event;

providing at least one premise-protecting control panel in communication with the sensor with a message response in some or all cases of sensor signals, wherein the message response is formatted in a voice-grade aural signal format;

providing a proximate network access device with a connection to the control panel and which converts the voice-grade aural signal format of the message response into a data format;

providing at least one remote receiver for receiving the message traffic of the control panel; and providing a data communications network for linking at least the network access device and receiver wherein the remote receiver is linked with the control panel at least in part by communicating over the data communications network.

14. The method of claim 13 wherein the network access device comprises a router configured with IP telephony.

* * * * *